US005466212A

United States Patent [19]

Springer

[11] Patent Number: 5,466,212

[45] Date of Patent: Nov. 14, 1995

[54] DEVICE FOR TROUBLE-FREE CONVEYANCE OF PRODUCTS IN A FOLDING APPARATUS

[75] Inventor: Johannes Springer, Heidelberg, Germany

[73] Assignee: Heidelberger Druckmaschinen AG, Heidelberg, Germany

[21] Appl. No.: 135,268

[22] Filed: Oct. 12, 1993

[30] Foreign Application Priority Data

Oct. 12, 1992 [DE] Germany ..... 42 34 307

[51] Int. Cl.[6] ..... B65H 45/16; B31B 1/12

[52] U.S. Cl. ..... 493/434; 493/442; 493/471; 492/48

[58] Field of Search ..... 493/416, 418, 493/434, 435, 442, 450, 471, 474, 424; 492/48

[56] References Cited

U.S. PATENT DOCUMENTS

| | | | |
|---|---|---|---|
| 2,837,775 | 6/1958 | Rockoff | 492/48 |
| 2,843,883 | 7/1958 | Rockoff | 492/48 |
| 2,863,175 | 12/1958 | Meyer | 492/48 |
| 3,147,698 | 9/1964 | Ross et al. | 492/48 |
| 3,349,693 | 10/1967 | Mitchell, Jr. | 492/48 |
| 3,820,774 | 6/1974 | Hertrich | 493/471 |
| 3,852,862 | 12/1974 | Sukenik | 492/48 |
| 4,521,007 | 6/1985 | Davda | 270/47 |
| 4,648,586 | 3/1987 | Michalik | 270/50 |
| 4,697,805 | 10/1987 | Herb | 270/47 |
| 4,817,932 | 4/1989 | Stöb et al. | 270/47 |
| 4,917,664 | 4/1990 | Lacaux | 493/471 |
| 5,104,367 | 4/1992 | Hill | 493/471 |
| 5,129,876 | 7/1992 | Brabant et al. | 493/471 |
| 5,230,124 | 7/1993 | Booth | 492/48 |

FOREIGN PATENT DOCUMENTS

| | | | |
|---|---|---|---|
| 2218085 | 12/1982 | Germany | 493/450 |
| 81339984 | 12/1983 | Germany . | |
| 3321577 | 12/1984 | Germany . | |
| 3512308 | 10/1986 | Germany . | |
| 3705195 | 9/1988 | Germany . | |

*Primary Examiner*—Bruce M. Kisliuk
*Assistant Examiner*—Christopher W. Day
*Attorney, Agent, or Firm*—Herbert L. Lerner; Laurence A. Greenberg

[57] ABSTRACT

Device for trouble-free conveyance of products in a folding apparatus both through a nip between two product-guiding cylinders and through a rearwardly extending wedge region bounded laterally by circumferential surfaces of both of the cylinders and at the top by a guiding device for the product to be conveyed includes a compressible covering on a respective one of the cylinders taking over a product, the compressible covering being formed with a plurality of chambers closable off by a section of the product.

8 Claims, 2 Drawing Sheets

Figure 3:
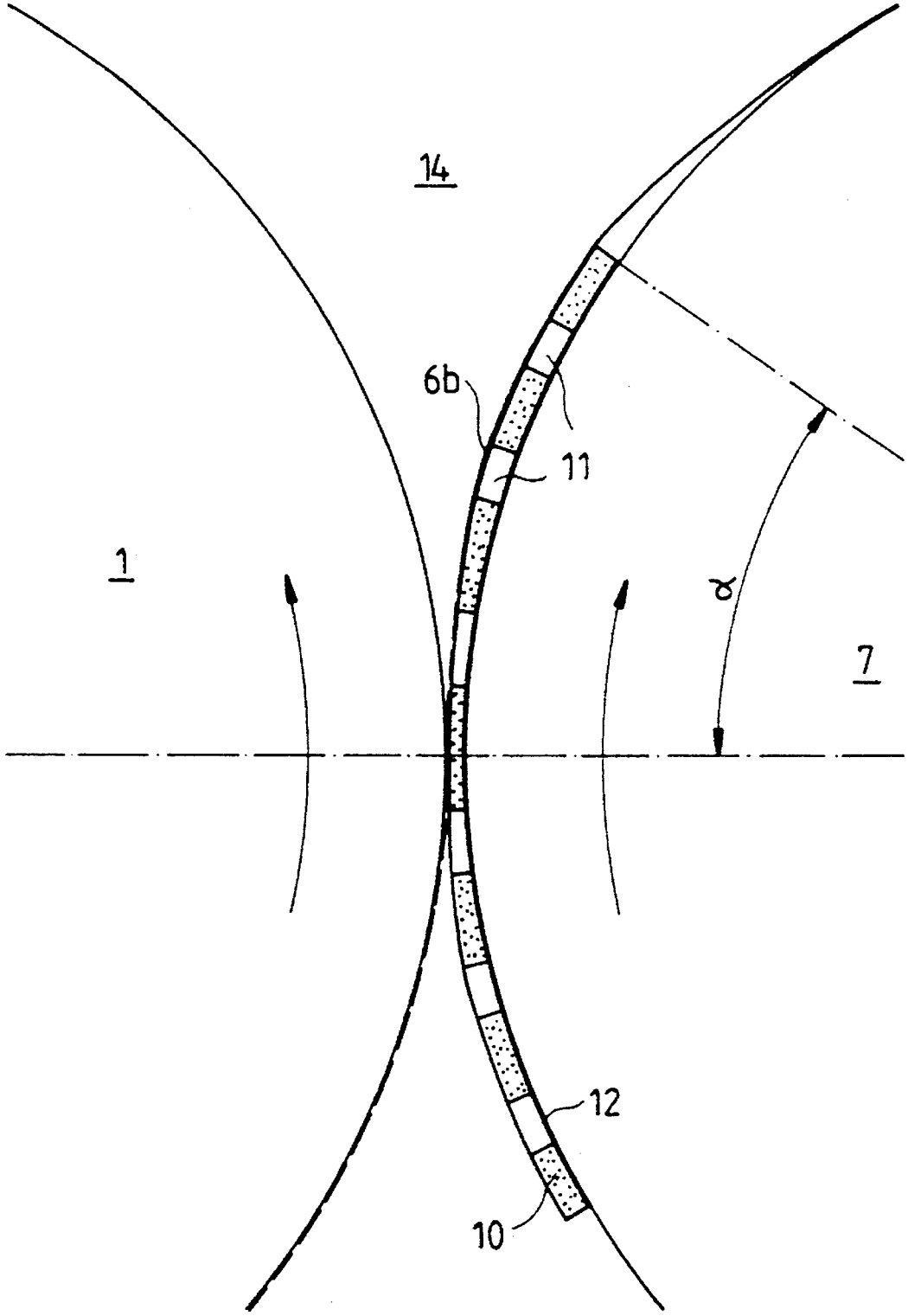

Fig.1
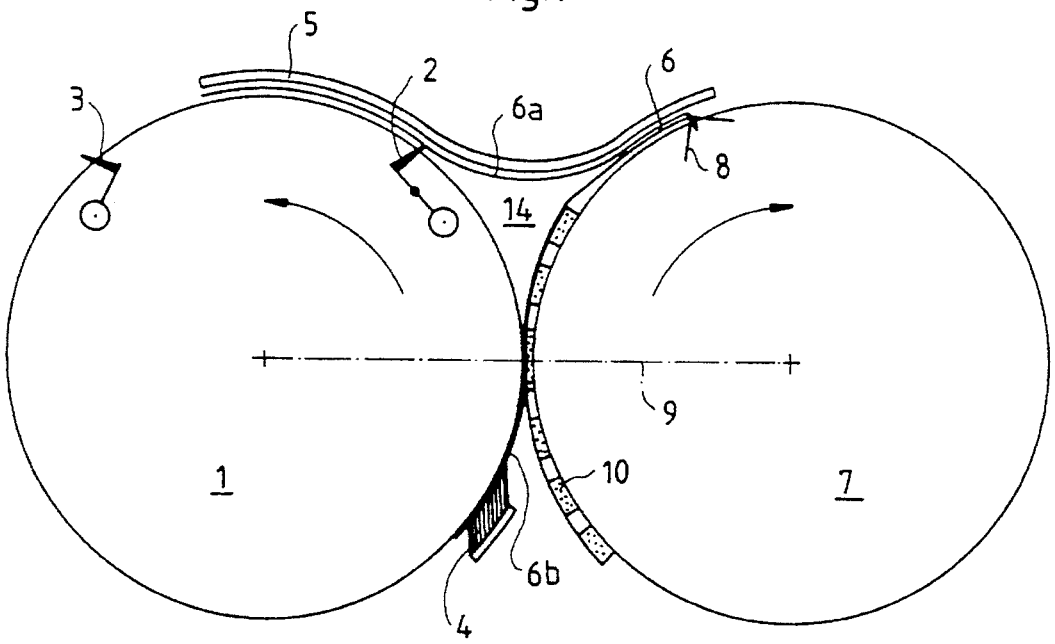
Fig. 2b
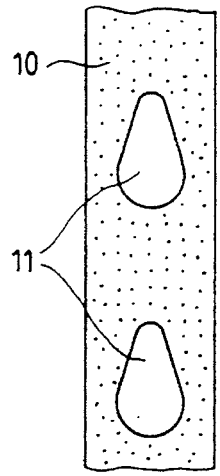
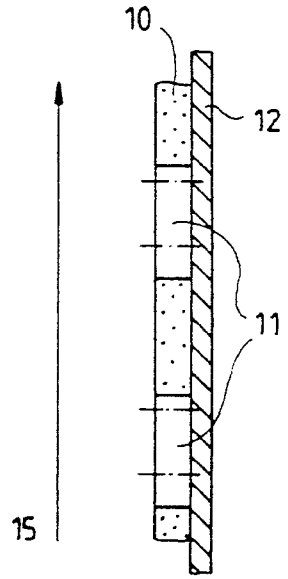
Fig. 2a

DEVICE FOR TROUBLE-FREE CONVEYANCE OF PRODUCTS IN A FOLDING APPARATUS

SPECIFICATION

The invention relates to a device for trouble-free conveyance of products in a folding apparatus and, more particularly, both through a nip between two product-guiding cylinders, as well as through a rearwardly extending wedge region bounded laterally by circumferential surfaces of both of the cylinders and at the top by a guiding device for the product to be conveyed.

Published German Patent Document 37 05 195 A1 discloses a guiding device in a cylinder wedge between two cooperating cylinders. A rotary part seated on bearing stubs has adjustable connection pieces which assure a continuous guidance of a leading product section, but a trailing product section is left to move out of the cylinder nip into the wedge region by itself.

A cross-folding device similar to the guiding device disclosed by the aforementioned published German Patent Document 37 05 195 A1 is also disclosed in published German Patent Document 35 12 308 C2. This cross-folding device also has a rotatable center part, however, connection pieces thereof are formed with a tangential transition yet stationary. It is also not possible to guide the trailing end of a folded product emerging from the nip between the folding cylinder surfaces by means of this cross-folding device.

Finally, the published German Patent Document 33 21 577 C2 discloses braking brushes in the folding apparatus of rotary printing presses. It is possible to act only upon a trailing product end by means of the braking brushes placed against the circumference of a folding blade cylinder. The active region of the braking brushes in the lower wedge region between the folding blade cylinder and the folding jaw cylinder, however, is limited by the contour of the lower cylinder wedge. The holding and braking force exerted by the brushes is no longer effective after having left the brush region, so that the trailing product end is suddenly relieved when entering the cylinder nip and tends to bunch up in the upper region of the cylinder wedge. The flapping and whipping movements of the trailing product section occurring in this regard also disrupt the course of movement of the leading product section and are therefore highly undesirable.

The disadvantages of the prior art as outlined hereinbefore are overcome in a relatively simple manner by the invention of the instant application.

It is accordingly an object of the invention to provide a device for trouble-free conveyance of products in a folding apparatus wherein the transition of a folded product region of a folded product between product-guiding cylinders is optimized.

With the foregoing and other objects in view, there is provided, in accordance with the invention, a device for trouble-free conveyance of products in a folding apparatus both through a nip between two product-guiding cylinders and through a rearwardly extending wedge region bounded laterally by circumferential surfaces of both of the cylinders and at the top by a guiding device for the product to be conveyed, comprising a compressible covering on a respective one of the cylinders taking over a product, the compressible covering being formed with a plurality of chambers closable off by a section of the product.

The advantages resulting from this construction are that the section of the folding product moving into the nip between the product-guiding cylinders is pressed against the covering, which is aided by the narrowness of the nip. Accordingly, the effects upon the folding product section begun by the brush guides is decisively extended. The compression of the covering in the nip between the product-guiding cylinders permits the air entrained in the chambers of the covering to escape and the chambers are then closed by the sections of the folding products in the region of the covering in the nip. With the continued rotation of the product-guiding cylinders, i.e., when the product is conveyed out of the nip, the covering again assumes its original thickness. The underpressure or vacuum generated in this manner in the chambers of the covering, because of their increase in volume, maintains the trailing product end against the circumference of the cylinder, while the back of the folding product is received by the folding jaw. Because this product section is fixed at both ends, flapping and whipping effects are eliminated.

In accordance with another feature of the invention, the one cylinder has a gripper device in vicinity of the circumference thereof, the compressible covering, as viewed in direction of product movement, being disposed on the circumference of the one cylinder before or ahead of the gripper device.

In accordance with a further feature of the invention, the covering on the circumference of the one cylinder extends essentially over a rear region of a shell segment of the one cylinder, as viewed in the conveying direction of the product. The covering on the circumference of the one cylinder thus extends on both sides of a central cylinder line extending between the cylinders. This has the advantage of making it possible to process different sizes of folding products, wherein assurance is provided that in the nip and the upper wedge regions, respectively, the trailing product end experiences the dependable effect of tight stretching of the gripped folding product section.

In accordance with an added feature of the invention, the covering is fastened in the form of individual strips to the circumference of the one cylinder.

In accordance with an alternative feature of the invention, the covering is fastened in the form of a plate to the circumference of the one cylinder.

In accordance with an additional feature of the invention, the covering has an underlay.

In accordance with yet another feature of the invention, the chambers formed in the covering are disposed behind one another, as viewed in the product movement direction.

In accordance with a concomitant feature of the invention, the chambers formed in the covering have a drop-like shape.

Other features which are considered as characteristic for the invention are set forth in the appended claims.

Although the invention is illustrated and described herein as embodied in a device for trouble-free conveyance of products in a folding apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic end view of two product-guiding cylinders and showing the transition of a folding product therebetween;

FIGS. 2*a* and 2*b* are respective enlarged fragmentary sectional and plan views of the strip-like covering section of FIG. 1;

FIG. 3 is an enlarged fragmentary view of FIG. 1 showing the compression and release of the covering in the nip or in the upper wedge region.

Referring now to the drawings and, first, particularly to FIG. 1 thereof, there is shown therein the transition of a folding product between two product-guiding cylinders. A product 6 brought to the circumference of a folding or tucker blade cylinder 1 is held against the circumference thereof by impaling pins 3, assisted by brushes 4 which can be placed against it. The back of the product is pushed by means of a folding or tucker blade 2, which folds the product 6 in parallel, into a folding jaw 8 of a folding jaw cylinder 7 as a function of the mode of operation, as to whether a second crosswise fold or a delta fold is to be made. The folding jaw 8 gripping the folding spine of the product 6 pulls the product, which is released from the impaling pins 3, away from the circumference of the folding blade cylinder 1. In this regard, the sections of the product 6 shown in FIG. 1, namely the leading product end 6*a* and the trailing product end 6*b*, respectively take different paths. The leading product end 6*a* is continuously guided along a guide plate 5, while the trailing product end 6*b*, which leaves the active region of the brushes 4 enters the nip between the product-guiding cylinders 1 and 7.

A covering 10 is applied to the circumference of the folding jaw cylinder 7, the extent of which along the circumference of the folding jaw cylinder 7 is of such size that it is possible to receive the trailing product ends 6*b* of simply cross-folded as well as delta-folded products 6. During entry into the nip, air is pressed out of the individual chambers 11, which are disposed one behind the other in the circumferential direction, due to the compression of the covering 10. In this compressed state, the openings of the chambers 11 are closed by the trailing product end 6*b*, which clings to the surface of the covering. When the trailing product end 6*b* resting against the covering 10 moves out of the nip, the covering 10 (also see FIG. 3) again assumes its original thickness. Due to the buildup of underpressure or vacuum going hand-in-hand with the increase in volume of the chambers 11, which were closed by the trailing product end 6*b*, the trailing product end 6*b* clings to the surface of the folding jaw cylinder 7 in the region of the upper cylinder wedge 14. No flapping and no whipping motions of the trailing product end 6*b* occur.

FIGS. 2*a* and 2*b* show part of a strip-like covering section.

The covering 10 can be formed as a plate covering a complete section of the cylinder shell or jacket of the folding jaw cylinder 7, or of individual strips disposed adjacent one another in the axial direction. To provide better air discharge, ventilating channels or conduits can extend through the plates, in particular in the central area. The chambers 11 have a drop-like shape in the strips shown in FIG. 2, the narrowest location of the shape is oriented in the direction of product movement represented by the arrow 15. Oval shapes, longitudinal slits or similar shapes of the individual chambers 11, as well as a succession of different geometries in the circumferential direction as well as in the axial direction of the folding jaw cylinder 7 would be conceivable. The compressible covering can be provided with an underlay or substrate 12 which is largely non-elastic, by means of which the covering 10 can be fastened to the circumference of the folding jaw cylinder 7. The ratio of the compressible covering 10 to the incompressible substrate 12 can be adjusted by the thickness of the incompressible substrate 12 as a function of the cylinder nip between the product-guiding cylinders 1 and 7. Because the chambers 11 are located in the compressible covering 10, a briefly acting suction force is generated by the compression. Thus, with different paper surface weights or grammage, it is possible by the selection of the substrate 12 to take different product requirements into account.

FIG. 3 shows the compression and release of the covering during the passage thereof through the nip between the product-guiding cylinders.

The trailing product end 6*b*, which remains on the circumference of the folding blade cylinder 1, and the covering 10 of the folding jaw cylinder 7 move together into the cylinder nip. The air in the chambers 11 is forced out during the continued rotation of the cylinders, and the chambers in their compressed state are closed off by the trailing product end 6*b*. When leaving the nip, an underpressure is briefly created by the release of the covering 10, which keeps the trailing product end 6*b* against the circumference of the folding jaw cylinder across the active region 15. It is possible to utilize the forces present in the nip, which can be affected by the compressibility of the covering, for guiding the product in the upper wedge region 14 by means of a covering 10, which is either in strip form or is a plate structure, extending in the circumferential direction of the folding jaw cylinder 7 on both sides of a central cylinder line 9 without requiring any elaborate internals or installations thereat. Besides a configuration of the covering 10 on both sides of a central cylinder line 9, as shown in FIG. 3, with product-guiding cylinders of different sizes it is possible to fasten the covering 10 on the cylinder shell or jacket respectively in such a way that it is disposed, facing in the direction of rotation of the cylinder taking over the folded product, in the rear region of the shell or jacket segment of the cylinder respectively covered by a product. Assurance is thereby provided that, even with folding product-guiding cylinders of different sizes, after its passage through the cylinder nip, the trailing product ends 6*b* are guided in an operationally reliable manner into the upper cylinder wedge 14, where the adhesive force slowly diminishes following the atmospheric pressure equalization by the walls of the chambers 11.

Furthermore, because of the slight compressive force acting in the nip, a pulling force is provided which continuously stretches the trailing product end 6*b* tightly and counteracts the formation of corrugations.

I claim:

1. A device for trouble-free conveyance of sheet-like material in a folding apparatus, comprising:

two sheet-guiding cylinders defining a nip at which a sheet enters in between said cylinders, a sheet-guiding device disposed adjacent said cylinders such that said cylinders and said sheet-guiding device together define a wedge region at which said sheet exits from between said cylinders, said wedge being bounded laterally by circumferential surfaces of said cylinders and by said sheet-guiding device, a compressible covering having a plurality of holes formed thereon, said compressible covering disposed on a respective outer circumferential surface of one of said cylinders, wherein each hole forms a chamber bounded by respective sides of the hole and by the circumferential surface of the cylinder for suctionally gripping the sheet-like material.

2. Device according to claim 1, wherein the one cylinder has a gripper device in vicinity of the circumference thereof, said compressible covering, as viewed in a direction of sheet movement, being disposed on the circumference of the one cylinder before said gripper device.

3. Device according to claim 1, wherein said covering on the circumference of the one cylinder extends essentially over a rear region of a shell segment of the one cylinder, as viewed in a direction of sheet movement.

4. Device according to claim 1, wherein said covering is fastened in the form of individual strips to the circumference of the one cylinder.

5. Device according to claim 1, wherein said covering is fastened in the form of a plate to the circumference of the one cylinder.

6. Device according to claim 1, wherein said covering has an underlay.

7. Device according to claim 1, wherein said chambers formed in said covering are disposed behind one another, as viewed in the sheet movement direction.

8. Device according to claim 1, wherein said chambers formed in said covering have a drop-like shape.

* * * * *